US008189019B2

(12) United States Patent
Koroishi et al.

(10) Patent No.: US 8,189,019 B2
(45) **Date of Patent: *May 29, 2012**

(54) THERMAL HEAD, THERMAL PRINTER, AND MANUFACTURING METHOD FOR THERMAL HEAD

(75) Inventors: Keitaro Koroishi, Chiba (JP); Noriyoshi Shoji, Chiba (JP); Toshimitsu Morooka, Chiba (JP); Norimitsu Sanbongi, Chiba (JP); Yoshinori Sato, Chiba (JP)

(73) Assignee: Seiko Instruments Inc., Chiba (JP)

( * ) Notice: Subject to any disclaimer, the term of this patent is extended or adjusted under 35 U.S.C. 154(b) by 308 days.

This patent is subject to a terminal disclaimer.

(21) Appl. No.: 12/613,887

(22) Filed: Nov. 6, 2009

(65) Prior Publication Data

US 2010/0134581 A1 Jun. 3, 2010

(30) Foreign Application Priority Data

Nov. 28, 2008 (JP) ..... 2008-304372

(51) Int. Cl.
*B41J 2/335* (2006.01)

(52) U.S. Cl. ..... 347/200; 200/204

(58) Field of Classification Search ..... 347/200, 347/205, 206, 208, 209, 47, 204
See application file for complete search history.

(56) References Cited

U.S. PATENT DOCUMENTS

2007/0091161 A1* 4/2007 Shoji et al. ..... 347/200
2010/0013891 A1* 1/2010 Matsuo ..... 347/47

FOREIGN PATENT DOCUMENTS

JP 2007-083532 A 4/2007

* cited by examiner

*Primary Examiner* — Kristal Feggins
(74) *Attorney, Agent, or Firm* — Brinks Hofer Gilson & Lione

(57) ABSTRACT

To improve printing quality and reduce manufacturing cost, a plurality of heating resistors (14) are arranged with spaces therebetween on a heat storage layer (13) laminated on a surface of a supporting substrate (11) via an adhesive layer (12) made of an elastic material. A cavity portion (19) is formed at a region between the supporting substrate (11) and the heat storage layer (13), the region being opposed to a heat generating portion of each of the plurality of heating resistors (14). The adhesive layer (12) includes a first adhesive layer (12*a*) laminated on the surface of the supporting substrate (11) and a second adhesive layer (12*b*) laminated on a surface of the heat storage layer (13). The elastic material constituting the second adhesive layer (12*b*) is arranged so that the elastic material is in a bonded state with respect to at least a part of the surface of the heat storage layer (13) opposed to the cavity portion (19).

6 Claims, 11 Drawing Sheets

THERMAL HEAD, THERMAL PRINTER, AND MANUFACTURING METHOD FOR THERMAL HEAD

RELATED APPLICATIONS

This application claims priority under 35 U.S.C. §119 to Japanese Patent Application No. JP2008-304372 filed on Nov. 28, 2008, the entire content of which is hereby incorporated by reference.

BACKGROUND OF THE INVENTION

1. Field of Invention

The present invention relates to a thermal head and a manufacturing method therefore, and a thermal printer, the thermal head being used in the thermal printer often mounted to a portable information equipment terminal typified by a compact hand-held terminal and being used to perform printing on a thermal recording medium based on printing data with the aid of selective driving of a plurality of heating elements.

2. Description of the Related Art

Recently, the thermal printers have been widely used in the portable information equipment terminals. The portable information equipment terminals are driven by a battery, which leads to strong demands for electric power saving of the thermal printers. Accordingly, there have been growing demands for thermal heads having high heat generating efficiency.

As a thermal head having high heat generating efficiency, one which has a structure disclosed, for example, in Japanese Patent Application Laid-Open No. 2007-83532 is known.

However, in the thermal head disclosed in FIG. 3 of Japanese Patent Application Laid-Open No. 2007-83532, a substrate (supporting substrate) and a heat storage layer are bonded to each other by anode bonding. Therefore, if a monocrystal silicon substrate having the thermal expansion coefficient of $3.3\times10^{-6}$ per degree centigrade is used as the substrate, and if soda glass that is inexpensive and has good workability but has the thermal expansion coefficient of $8.6\times10^{-6}$ per degree centigrade is used for the heat storage layer, a thermal expansion difference occurs between the substrate and the heat storage layer because of the temperature of a heating resistor that rises up to approximately 200 to 300 degrees centigrade when the thermal head is energized. As a result, a warpage or a distortion may occur in the thermal head so that the thermal head cannot contact correctly with thermal recording paper, which may cause a deterioration in print quality.

In contrast, if a monocrystal silicon substrate having the thermal expansion coefficient of $3.3\times10^{-6}$ per degree centigrade is used as the substrate, and if Pyrex glass that is expensive and has bad workability but has the thermal expansion coefficient of $3.2\times10^{-6}$ per degree centigrade is used for the heat storage layer, a warpage or a distortion does not occur in the thermal head. However, there are problems that manufacturing cost increases and that manufacturing steps are complicated.

On the other hand, in the thermal head disclosed in FIG. 4 of the above Japanese Patent Application Laid-Open No. 2007-83532, the substrate and the heat storage layer are bonded to each other via an adhesive layer (bonding layer), and the adhesive layer forms a cavity portion. However, this adhesive layer must be made of an expensive high heat-resistance material that can endure temperature of the heating resistor that rises up to approximately 200 to 300 degrees centigrade when the thermal head is energized. Therefore, there is a problem that manufacturing cost is increased.

SUMMARY OF THE INVENTION

The present invention has been made to solve the problems described above, and it is an object thereof to provide a thermal head that can improve print quality and reduce manufacturing cost.

In order to solve the problems described above, the present invention adopts the following means.

A thermal head according to the present invention, a plurality of heating resistors are arranged with spaces therebetween on a heat storage layer laminated on a surface of a supporting substrate via an adhesive layer made of an elastic material. A cavity portion is formed at a region between the supporting substrate and the heat storage layer, the region being opposed to a heat generating portion of each of the plurality of heating resistors. The adhesive layer includes a first adhesive layer laminated on the surface of the supporting substrate and a second adhesive layer laminated on a surface of the heat storage layer. The elastic material constituting the second adhesive layer is arranged so that the elastic material is in a bonded state with respect to at least a part of the surface of the heat storage layer opposed to the cavity portion.

According to the thermal head of the present invention, only the second adhesive layer laminated on the another surface of the heat storage layer is made of an expensive high heat-resistance material, and the first adhesive layer laminated on the one surface of the supporting substrate can be made of an inexpensive material. Therefore, manufacturing cost can be reduced.

In addition, the surface of the heat storage layer is covered with the second adhesive layer made of a resin so that the second adhesive layer reinforces the heat storage layer (mechanical strength of the heat storage layer is increased (improved)). Therefore, the thickness of the heat storage layer can be reduced (to be 20 μm or smaller), and hence a time period for storing sufficient heat in the heat storage layer can be shortened. Thus, it is possible to eliminate a defective condition that the print density is low when the printing is started.

Further, the another surface of the heat storage layer is covered with the adhesive layer made of a resin so that the adhesive layer reinforces the heat storage layer (mechanical strength of the heat storage layer is increased (improved)). Therefore, the thickness of the heat storage layer can be reduced (to be 20 μm or smaller), and hence a time period for storing sufficient heat in the heat storage layer can be shortened. Thus, it is possible to eliminate a defective condition that the print density is low when the printing is started.

Still further, an amount of heat input into the heat storage layer when the printing is started can be reduced by decreasing the thickness of the heat storage layer. Therefore, a thermal load applied to the entire thermal head can be reduced, and hence durability and reliability can be improved.

Still further, the thermal expansion difference that occurs between the supporting substrate and the heat storage layer because of the temperature of the heating resistors that rises up to approximately 200 to 300 degrees centigrade when the thermal head is energized is absorbed by elastic deformation of the adhesive layer made of an elastic material. Therefore, a warpage or a distortion is eliminated (or reduced) when the thermal head is energized, and hence the print quality can be maintained to be always in an optimal condition.

Still further, even if a monocrystal silicon substrate is adopted as a material of the supporting substrate, soda glass that is inexpensive and has good workability can be adopted as a material of the heat storage layer. Therefore, manufacturing cost can be reduced and manufacturing steps can be simplified.

Still further, beneath the region covered with a heat generating portion of each of the plurality of heating resistors (region opposed to the heat generating portion), there is formed a cavity portion having a sufficient height (depth) for improving the heat generating efficiency, that is, a heat insulating layer for restricting heat flowing into the supporting substrate from the heat storage layer. Therefore, the heat generating efficiency can be improved.

In the thermal head described above, it is more preferred that the entire surface of the heat storage layer be covered with the second adhesive layer.

According to the thermal head described above, the entire of the another surface of the heat storage layer is covered with the adhesive layer made of a resin so that this adhesive layer further reinforces the heat storage layer (mechanical strength of the heat storage layer is further increased (improved)). Therefore, the thickness of the heat storage layer can be further reduced so that the time period for storing sufficient heat in the heat storage layer can be further shortened. Thus, the defective condition that the print density is low when the printing is started can be eliminated.

In the thermal head described above, it is more preferred that a part of the back surface of the heat storage layer opposed to the surface of the supporting substrate exposed to the cavity portion be exposed to the cavity portion.

According to the thermal head described above, a part of the another surface of the heat storage layer positioned beneath the region covered with a heat generating portion of each of the plurality of heating resistors (region opposed to the heat generating portion) is exposed to the cavity portion. Therefore, heat dissipation via the adhesive layer is further suppressed so that the heat generating efficiency can be further improved.

The thermal printer of the present invention is provided with a thermal head having high heat generating efficiency.

According to the thermal printer of the present invention, printing on thermal recording paper can be performed with small electric power, and hence duration time of a battery can be lengthened and reliability of the entire printer can be improved.

In a manufacturing method for a thermal head, a plurality of heating resistors are arranged with spaces therebetween on a heat storage layer laminated on a surface of a supporting substrate via an adhesive layer made of an elastic material. A cavity portion is formed at a region between the supporting substrate and the heat storage layer, the region being opposed to a heat generating portion of each of the plurality of heating resistors. The manufacturing method for the thermal head includes the steps of: laminating a first adhesive layer made of an elastic material on an entire surface of the supporting substrate; forming a first concave portion in a surface of the first adhesive layer; laminating a second adhesive layer made of an elastic material on an entire surface of the heat storage layer; forming a second concave portion in a surface of the second adhesive layer; and bonding the first adhesive layer and the second adhesive layer to each other so that the first concave portion and the second concave portion formed respectively in the first adhesive layer and the second adhesive layer are combined.

According to the manufacturing method for the thermal head of the present invention, only the second adhesive layer laminated on the another surface of the heat storage layer is made of an expensive high heat-resistance material, and the first adhesive layer laminated on the one surface of the supporting substrate can be made of an inexpensive material. Therefore, manufacturing cost can be reduced.

In addition, the another surface of the heat storage layer is covered with the adhesive layer made of a resin, and the heat storage layer that is reinforced by this adhesive layer (having increased (improved) mechanical strength) is handled. Therefore, manufacturing steps can be simplified and manufacturing cost can be reduced.

Further, even if a monocrystal silicon substrate is adopted as a material of the substrate, soda glass that is inexpensive and has good workability can be adopted as a material of the heat storage layer. Therefore, manufacturing steps can be simplified and manufacturing cost can be reduced.

The manufacturing method for the thermal head described above, it is more preferred that the manufacturing method further include the step of exposing a part of the supporting substrate to an inside of the first concave portion.

According to the thermal head described above, a part of the surface of the supporting substrate positioned beneath the region covered with each of heat generating portions of the heating resistors (region opposed to the heat generating portion) is exposed to the cavity portion. Therefore, heat dissipation via the adhesive layer can be further suppressed, and hence the heat generating efficiency can be further improved.

The manufacturing method for the thermal head described above, it is more preferred that the manufacturing method further include the step of exposing a part of the heat storage layer to the inside of the second concave portion.

According to the thermal head described above, a part of the surface of the heat storage layer positioned beneath the region covered with each of heat generating portions of the heating resistors (region opposed to the heat generating portion) is exposed to the cavity portion. Therefore, heat dissipation via the adhesive layer can be further suppressed, and hence the heat generating efficiency can be further improved.

According to the present invention, effects of improving the print quality and reducing manufacturing cost can be obtained.

DETAILED DESCRIPTION OF THE PREFERRED EMBODIMENTS

Hereinafter, description is made of a first embodiment of a thermal head according to the present invention with reference to FIGS. 1 to 11.

Figure 1:
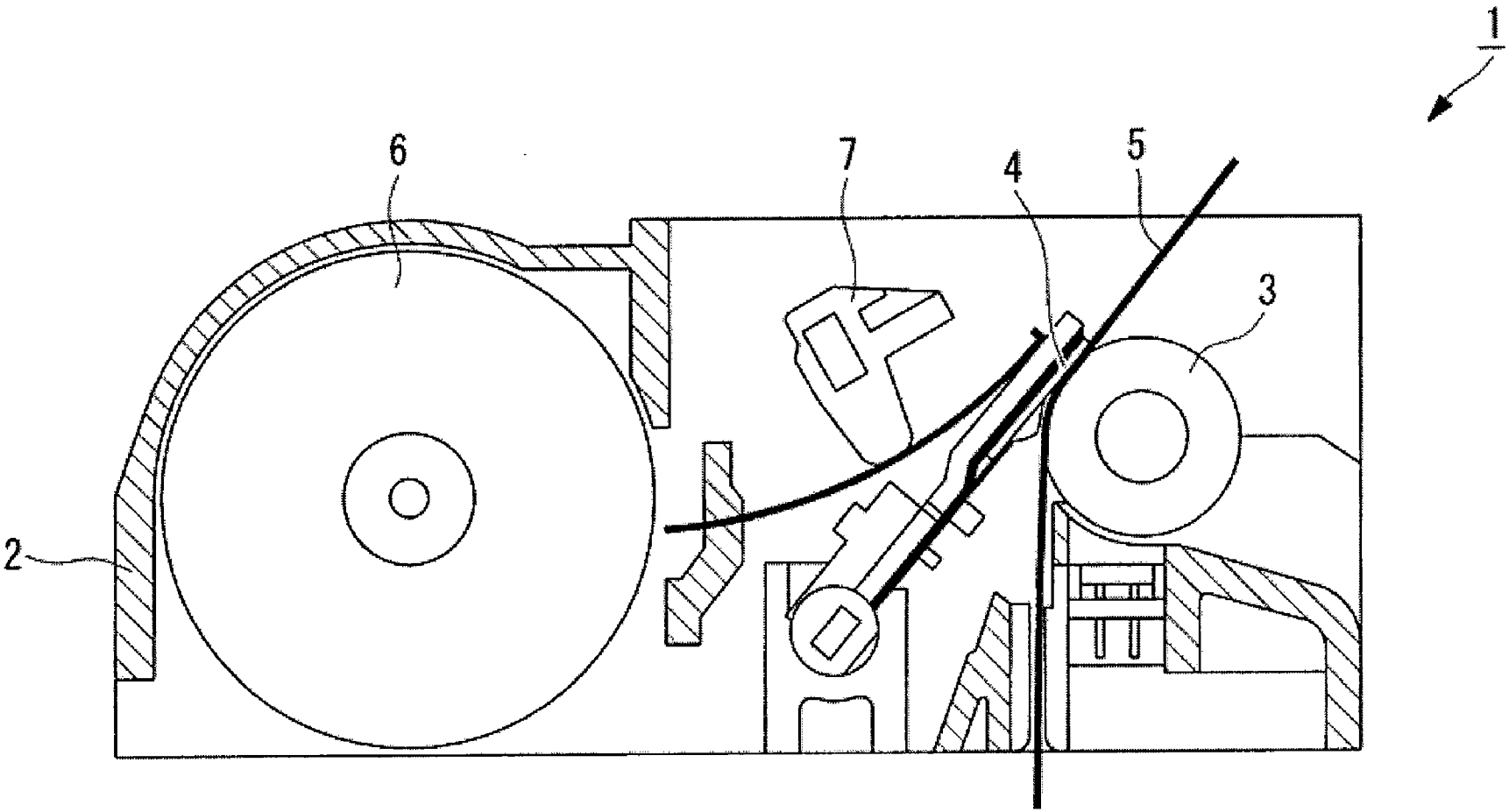
FIG. 1 is a longitudinal sectional view of a thermal printer provided with a thermal head according to the present invention.
Figure 2:
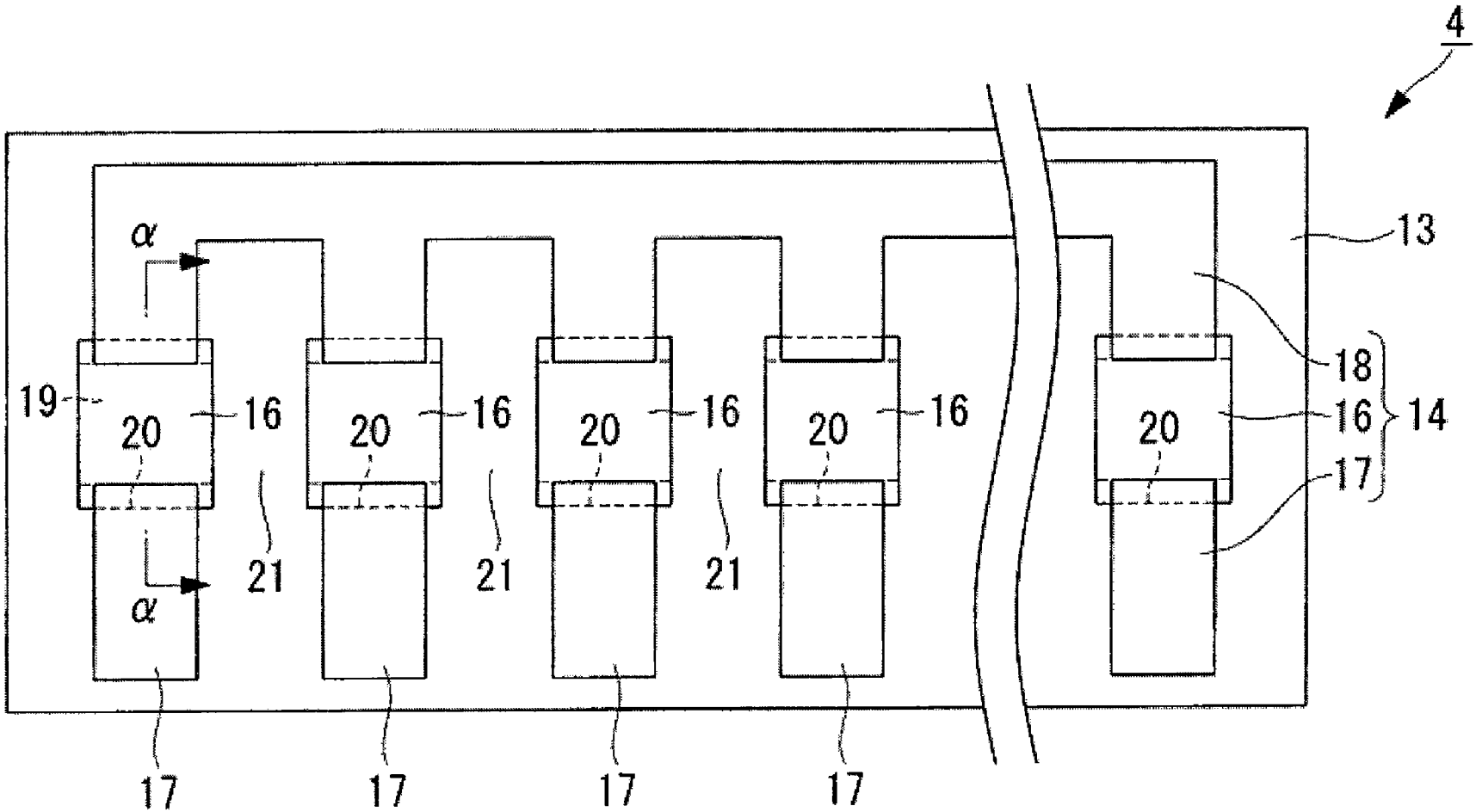
FIG. 2 is a plan view of a thermal head according to a first embodiment of the present invention, which illustrates a state of eliminating a protective film.
Figure 3:
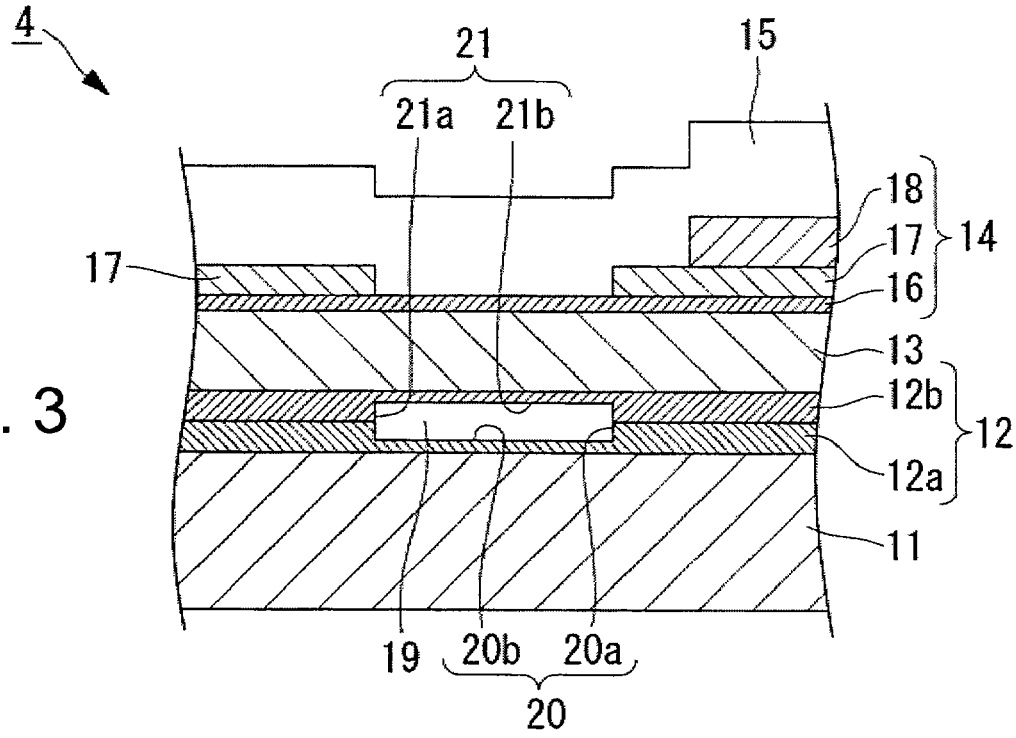
FIG. 3 is a cross sectional view taken along the arrow α-α in FIG. 2.

FIG. 1 is a longitudinal sectional view of a thermal printer provided with the thermal head of the present invention. FIG. 2 is a plan view of the thermal head according to this embodiment, which illustrates a state of eliminating a protective film. FIG. 3 is a sectional view taken along the arrow α-α of FIG. 2. FIGS. 4 to 11 are process diagrams for illustrating a manufacturing method for the thermal head according to this embodiment.

As illustrated in FIG. 1, a thermal printer 1 includes a main body frame 2, a platen roller 3 horizontally arranged, a thermal head 4 arranged oppositely to an outer peripheral surface of the platen roller 3, a paper feeding mechanism 6 for feeding out thermal recording paper 5 between the platen roller 3 and the thermal head 4, and a pressure mechanism 7 for pressing the thermal head 4 against the thermal recording paper 5 by a predetermined pressing force.

As illustrated in FIG. 2 or 3, the thermal head 4 includes a supporting substrate (hereinafter referred to as a "substrate") 11, an adhesive layer 12 made of an elastic material (or an elastic material layer or a stress relaxation layer) that is formed to cover the entire of one surface of the substrate 11 and the entire of another surface (lower surface in FIG. 3) of a heat storage layer 13, and the heat storage layer 13 that is bonded to the substrate 11 via the adhesive layer 12. In addition, one surface (upper surface in FIG. 3) of the heat storage layer 13 is provided with a plurality of heating resistors 14 that are formed (arranged) with spaces therebetween in one direction. Further, as illustrated in FIG. 3, the thermal head 4 includes a protective film 15 for covering the one surface (upper surface in FIG. 3) of the heat storage layer 13 and the heating resistor 14 so as to protect the same from abrasion and corrosion.

Note that, on another surface (lower surface in FIG. 3) of the substrate 11, there is provided a heat dissipation plate (not shown).

Each of the heating resistors 14 includes a heating resistor layer 16 formed on one surface of the heat storage layer 13 in a predetermined pattern, an individual electrode 17 formed on the one surface (upper surface in FIG. 3) of the heating resistor layer 16 in a predetermined pattern, and a common electrode 18 formed on one surface (upper surface in FIG. 3) of the individual electrode 17 in a predetermined pattern.

Note that, an actually heat generating portion of each of the plurality of the heating resistors 14 (hereinafter, referred to as "heat generating portion") is a portion not overlapped with the individual electrode 17 and the common electrode 18.

As illustrated in FIGS. 2 and 3, concave portions 20 and 21 are formed so as to form the cavity portion (hollow heat insulating layer) 19 for each of the heating resistors 14 in the adhesive layer 12 positioned beneath the region covered with the heat generating portion of each of the plurality of the heating resistors 14 (region opposed to the heat generating portion).

The cavity portion 19 is a space formed beneath the region covered with the heat generating portion of each of the plurality of the heating resistors 14 (region opposed to the heat generating portion), i.e., a space formed (enclosed) by wall surfaces 20*a* (that are perpendicular to the one surface of the substrate 11 and the another surface of the heat storage layer 13) constituting the concave portion (first concave portion) 20 and the bottom surface 20*b* (that is parallel to the one surface of the substrate 11 and the another surface of the heat storage layer 13), and a space formed (enclosed) by wall surfaces 21*a* (that are perpendicular to the one surface of the substrate 11 and the another surface of the heat storage layer 13) constituting the concave portion 21*b* (second concave portion) 21 and the bottom surface (that is parallel to the one surface of the substrate 11 and the another surface of the heat storage layer 13). Further, a space layer inside the cavity portion 19 has a function as a heat insulating layer for restricting heat flowing into the substrate 11 from the heating resistor 14.

Note that, the cavity portion 19 can have any size in a plan view. The cavity portion 19 may be larger than the heat generating portion like this embodiment or may be smaller than the heat generating portion, as long as the size thereof is close to the size of the heat generating portion.

In addition, the cavity portion 19 is formed by combining the concave portion 20 with the concave portion 21 to be glued.

The adhesive layer 12 bonds the one surface of the substrate 11 and the another surface of the heat storage layer 13 to each other, and absorbs a thermal expansion difference (thermal extension difference) that occurs between the substrate 11 and the heat storage layer 13. The adhesive layer 12 includes an adhesive layer (first adhesive layer) 12*a* bonded to the one surface of the substrate 11 and an adhesive layer (second adhesive layer) 12*b* bonded to the another surface of the heat storage layer 13.

As a material for the adhesive layer 12, there is used a high heat-resistance material capable of withstanding a temperature of the heating resistors 14 that rises up to approximately 200 to 300 degrees centigrade, for example, an organic resin material such as a polyimide resin, a polyamideimide resin, an epoxy resin, an acrylic resin, a silicone resin, or a fluororesin.

Next, description is made, with reference to FIGS. 4 to 11, of a manufacturing method for the thermal head 4 according to this embodiment.

Figure 4:
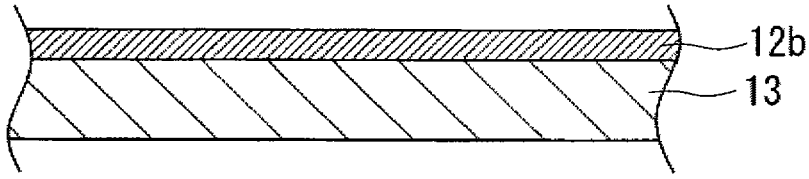
FIG. 4 is a process diagram for illustrating a manufacturing method for the thermal head according to the first embodiment of the present invention.

First, as illustrated in FIG. 4, the paste-like, liquid-like, film-like, or sheet-like adhesive layer 12*b* having a constant thickness (approximately 10 μm to 100 μm) is laminated (formed) on the entire of the another surface of the heat storage layer 13 having a constant thickness (approximately 2 μm to 100 μm).

Figure 5:
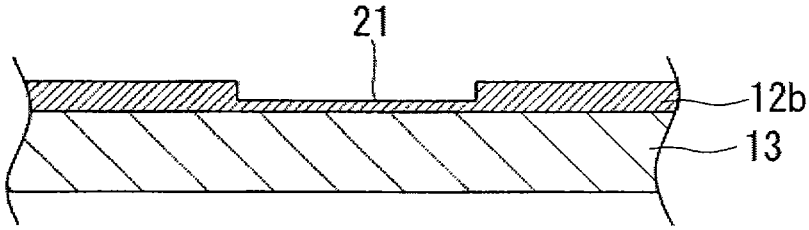
FIG. 5 is a process diagram for illustrating the manufacturing method for the thermal head according to the first embodiment of the present invention.

Further, as illustrated in FIG. 5, the another surface of the adhesive layer 12*b* is processed to form the concave portion 21 constituting the cavity portion 19, and hence the cavity portion (hollow heat insulating layer) 19 is formed beneath the region covered with the heat generating portion of each of the plurality of the heating resistors 14 (region opposed to the heat generating portion). Note that, the adhesive layer 12*b* positioned beneath the region covered with the heat generating portion of each of the plurality of the heating resistors 14 (region opposed to the heat generating portion) (i.e., the adhesive layer 12*b* at the region where the concave portion 21 is formed) has a constant thickness (approximately 2 to 40 μm).

Concerning material of the heat storage layer 13, for example, a glass substrate is used, which is made of soda glass having the thermal expansion coefficient of $8.6\times10^{-6}$ per degree centigrade, Pyrex glass having the thermal expansion coefficient of $3.2\times10^{-6}$ per degree centigrade, no alkali glass having the thermal expansion coefficient of $3.8\times10^{-6}$ per degree centigrade, or the like.

Figure 6:
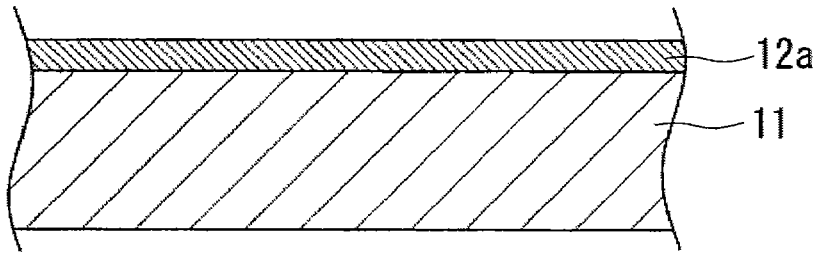
FIG. 6 is a process diagram for illustrating the manufacturing method for the thermal head according to the first embodiment of the present invention.

On the other hand, as illustrated in FIG. 6, the paste-like, liquid-like, film-like, or sheet-like adhesive layer 12*a* having a constant thickness (approximately 10 μm to 100 μm) is laminated (formed) on the entire of the another surface of the substrate 11 having a constant thickness (approximately 300 μm to 1 mm).

Figure 7:
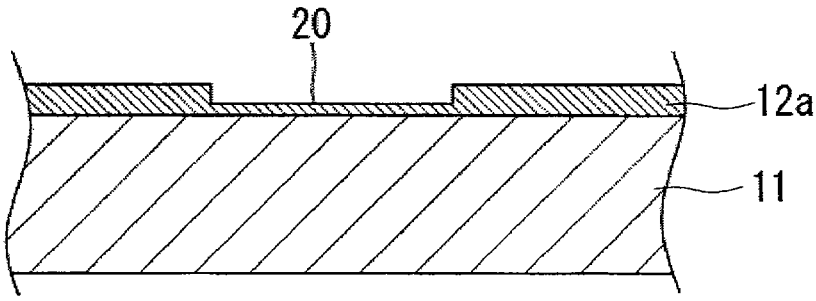
FIG. 7 is a process diagram for illustrating the manufacturing method for the thermal head according to the first embodiment of the present invention.

Further, as illustrated in FIG. 7, the one surface of the adhesive layer 12*a* is processed to form the concave portion 20 constituting the cavity portion 19, and hence the cavity portion (hollow heat insulating layer) 19 is formed beneath the region covered with the heat generating portion of each of the plurality of the heating resistors 14 (region opposed to the heat generating portion). Note that, the adhesive layer 12*a* positioned beneath the region covered with the heat generating portion of each of the plurality of the heating resistors 14 (region opposed to the heat generating portion) (i.e., the adhesive layer 12*a* at the region where the concave portion 20 is formed) has a constant thickness (approximately 2 to 40 μm).

Concerning material of the substrate 11, for example, a glass substrate, a monocrystal silicon substrate, or a ceramic substrate (alumina substrate) is used. The glass substrate is made of soda glass having the thermal expansion coefficient (thermal expansion ratio) of $8.6\times10^{-6}$ per degree centigrade, Pyrex glass having the thermal expansion coefficient of $3.2\times10^{-6}$ per degree centigrade, no alkali glass having the thermal expansion coefficient of $3.8\times10^{-6}$ per degree centigrade, or the like. The monocrystal silicon substrate has the thermal expansion coefficient of $3.3\times10^{-6}$ per degree centigrade. The ceramic substrate has the thermal expansion coefficient of $7.2\times10^{-6}$ per degree centigrade.

Figure 8:
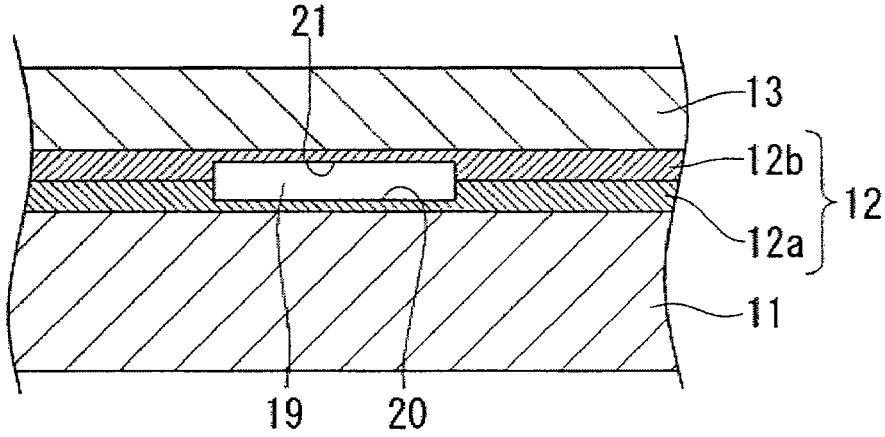
FIG. 8 is a process diagram for illustrating the manufacturing method for the thermal head according to the first embodiment of the present invention.
Figure 9:
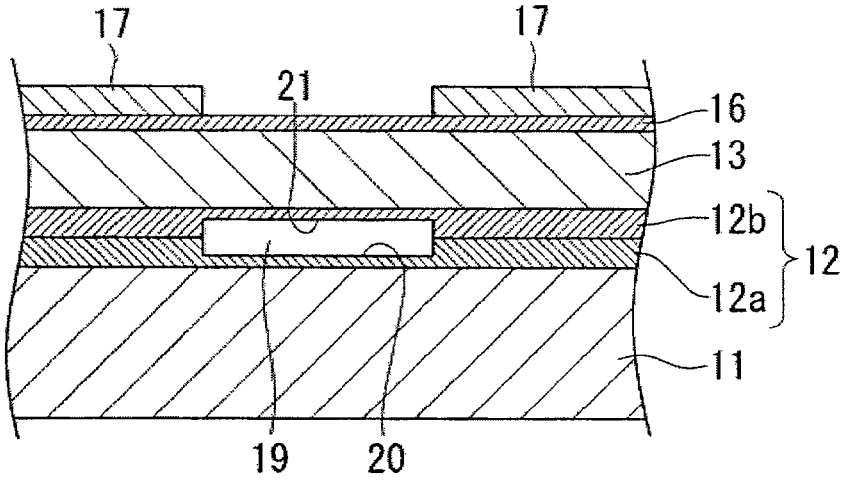
FIG. 9 is a process diagram for illustrating the manufacturing method for the thermal head according to the first embodiment of the present invention.
Figure 10:
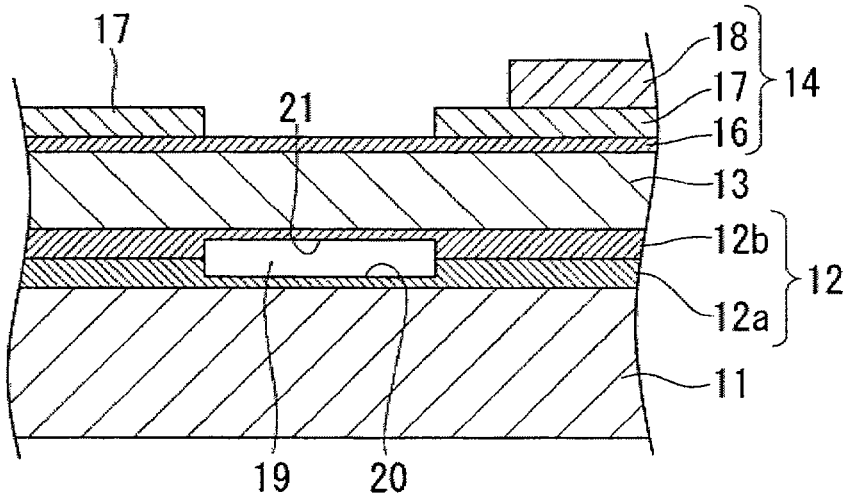
FIG. 10 is a process diagram for illustrating the manufacturing method for the thermal head according to the first embodiment of the present invention.
Figure 11:
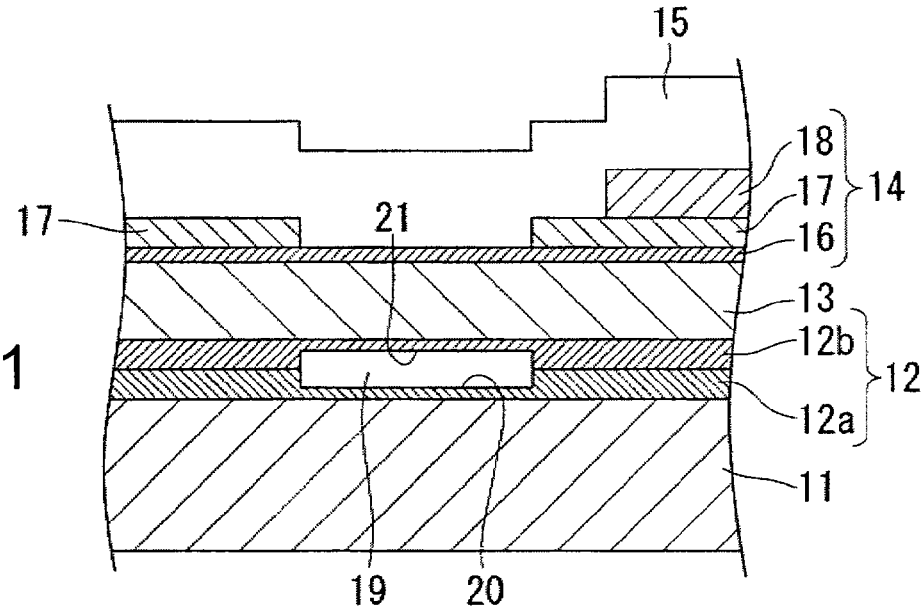
FIG. 11 is a process diagram for illustrating a manufacturing method for a thermal head according to the first embodiment of the present invention.

Next, as illustrated in FIG. 8, the adhesive layer 12*b* and the heat storage layer 13 obtained as illustrated in FIG. 5 is overlaid on the adhesive layer 12*a* and the substrate 11 obtained as illustrated in FIG. 7 so that the another surface of the adhesive layer 12*b* (surface opposite to the surface opposed to the heat storage layer 13) contacts with the one surface of the adhesive layer 12*a* and that the concave portion 20 and the concave portion 21 constitute the cavity portion 19. Then, a predetermined temperature and pressure are applied uniformly for a certain time period so that the substrate 11 and the heat storage layer 13 are bonded (glued) to each other.

Then, on the heat storage layer 13 formed as described above, the heating resistor layer 16 (see FIG. 7), individual electrodes 17 (see FIG. 9), a common electrode 18 (see FIG. 10), and the protective film 15 (see FIG. 11) are sequentially formed. Note that, the order of forming the heating resistor layer 16, the individual electrodes 17, and the common electrode 18 is arbitrary.

The heating resistor layer 16, the individual electrodes 17, the common electrode 18, and the protective film 15 can be manufactured by using a manufacturing method for those members of a conventional thermal head. Specifically, a thin film formation method such as sputtering, chemical vapor deposition (CVD), or vapor deposition is used to form a thin film made of a Ta-based or silicide-based heating resistor material on the insulating film. Then, the thin film made of the heating resistor material is molded by lift-off, etching, or the like, whereby the heating resistor having a desired shape is formed.

Similarly, the film formation with use of an electrode material such as Al, Al—Si, Au, Ag, Cu, and Pt is performed on the heat storage layer 13 by using sputtering, vapor deposition, or the like. Then, the film thus obtained is formed by lift-off or etching, or the electrode material is screen-printed and is burned thereafter, to thereby form the individual electrodes 17 and the common electrode 18 which have the desired shapes.

After the above-mentioned formation of the heating resistor layer 16, the individual electrodes 17, and the common electrode 18, the film formation with use of a protective film material such as $SiO_2$, $Ta_2O_5$, SiAlON, $Si_3N_4$, or diamond-like carbon is performed on the heat storage layer 13 by sputtering, ion plating, CVD, or the like, whereby the protective film 15 is formed.

According to the thermal head 4 of this embodiment, only the adhesive layer 12*b* laminated on the another surface of the heat storage layer 13 is made of the expensive high heat-resistance material, and the adhesive layer 12*a* laminated on the one surface of the substrate 11 can be made of an inexpensive material. Therefore, manufacturing cost can be reduced.

In addition, the entire of the another surface of the heat storage layer 13 is covered with the adhesive layer 12*b* made of a resin, and the heat storage layer 13 is reinforced by the adhesive layer 12*b* (mechanical strength of the heat storage layer 13 is increased (improved)). Therefore, the thickness of the heat storage layer 13 can be reduced (to be 20 μm or smaller), and hence the time for storing sufficient heat in the heat storage layer 13 can be shortened. Thus, the defective condition that the print density is low when the printing is started can be eliminated.

Note that, it is more preferred to use a resin having heat resistance property and high strength (e.g., an epoxy resin having an elasticity modulus of 1 to 2 GPa, a polyimide resin having an elasticity modulus of 4 GPa, a glass fiber reinforced resin (GFRP) having an elasticity modulus of 26 GPa, or a carbon fiber reinforced resin (CFRP) having an elasticity modulus of 26 GPa) as a material of the adhesive layer 12*b*, because the mechanical strength of the heat storage layer 13 can be further increased (improved).

Further, an amount of heat input into the heat storage layer 13 when the printing is started can be reduced by decreasing the thickness of the heat storage layer 13. Therefore, a thermal load applied to the entire thermal head 4 can be reduced, and hence durability and reliability can be improved.

Still further, the thermal expansion difference that occurs between the substrate 11 and the heat storage layer 13 because of the temperature of the heating resistor 14 that rises up to approximately 200 to 300 degrees centigrade when the thermal head 4 is energized is absorbed by elastic deformation of the adhesive layer 12 made of an elastic material. Therefore, a warpage or a distortion of the thermal head 4 is eliminated (or reduced) when the thermal head 4 is energized, and hence the print quality can be maintained to be always in an optimal condition.

Still further, even if a monocrystal silicon substrate is adopted as a material of the substrate 11, soda glass that is inexpensive and has good workability can be adopted as a material of the heat storage layer 13. Therefore, manufacturing cost can be reduced and manufacturing steps can be simplified.

Still further, beneath the region covered with a heat generating portion of each of the plurality of heating resistors 14 (region opposed to the heat generating portion), there is formed the cavity portion 19 having a sufficient height (depth) for improving the heat generating efficiency, that is, a heat insulating layer for restricting heat flowing into the substrate 11 from the heat storage layer 13. Therefore, the heat generating efficiency can be improved.

Further, according to the thermal printer 1 provided with the thermal head 4 according to this embodiment, because the thermal head 4 having high heat generating efficiency is provided, it is possible to perform printing onto the thermal recording paper 5 with small electric power. Therefore, it is possible to lengthen a duration time of a battery.

On the other hand, according to the manufacturing method for the thermal head 4 of this embodiment, only the adhesive layer 12*b* laminated on the another surface of the heat storage layer 13 is made of the expensive high heat-resistance material, and the adhesive layer 12*a* laminated on the one surface of the substrate 11 can be made of an inexpensive material. Therefore, manufacturing cost can be reduced.

In addition, the entire of the another surface of the heat storage layer 13 is covered with the adhesive layer 12 made of a resin, so as to handle the heat storage layer 13 reinforced by the adhesive layer 12*b* (having increased (improved) mechanical strength). Therefore, manufacturing cost can be reduced and manufacturing steps can be simplified.

Further, even if a monocrystal silicon substrate is adopted as a material of the substrate 11, soda glass that is inexpensive and has good workability can be adopted as a material of the heat storage layer 13. Therefore, manufacturing cost can be reduced and manufacturing steps can be simplified.

Note that, the paste-like or liquid-like adhesive layer 12*b* can be laminated on the entire of the another surface of the heat storage layer 13 by adopting methods including roll coating, printing, dipping, spin coating, spraying, and brush painting.

In addition, the film-like or sheet-like adhesive layer 12*b* can be laminated on the entire of the another surface of the heat storage layer 13 by adopting methods including pressing, bonding, and laminating.

Figure 12:
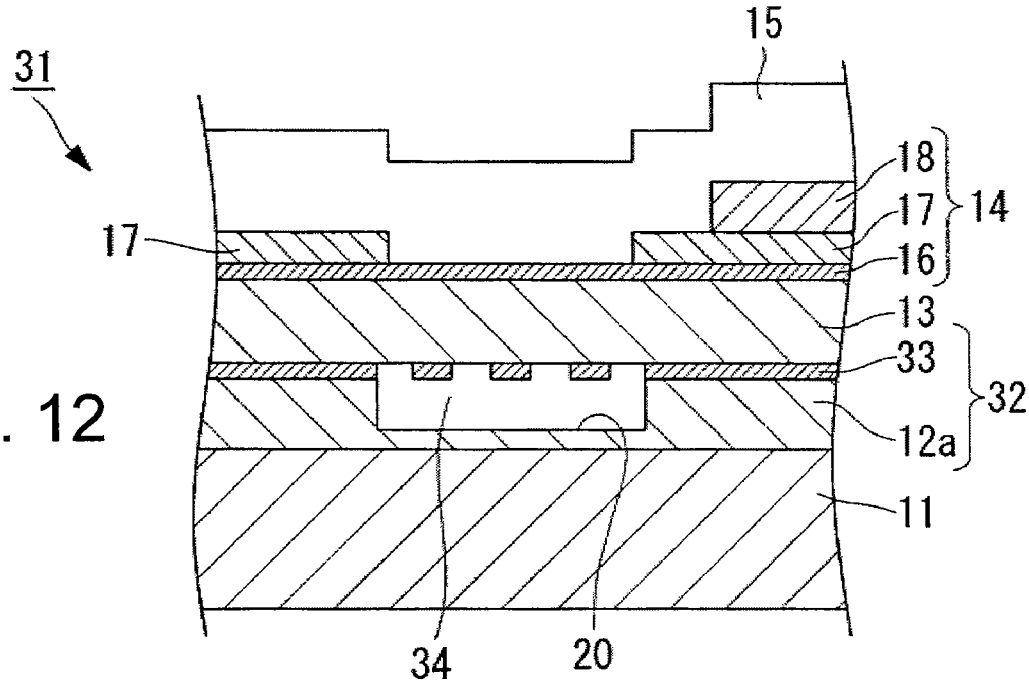
FIG. 12 is a cross sectional view of a thermal head according to a second embodiment of the present invention, which is similar to FIG. 3.

A second embodiment of a thermal head according to the present invention is described with reference to FIG. 12. FIG. 12 is a cross sectional view of the thermal head according to this embodiment, which is similar to FIG. 3.

As illustrated in FIG. 12, the thermal head 31 according to this embodiment is different from that of the first embodiment described above in that the former includes an adhesive layer 32 instead of the adhesive layer 12.

Other components are the same as those of the first embodiment described above, so description of the components is omitted here.

Figure 13:
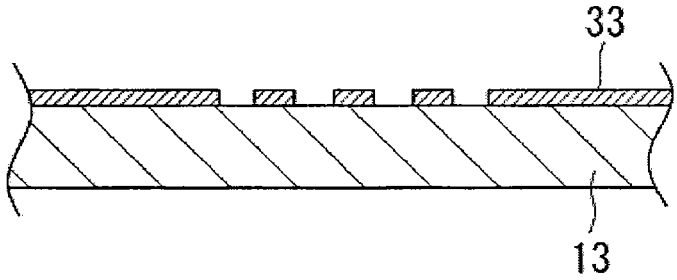
FIG. 13 is a process diagram for illustrating a manufacturing method for a thermal head according to the third embodiment of the present invention.

The manufacturing steps for the thermal head 31 according to this embodiment include the step illustrated in FIG. 13, i.e., the step of patterning the paste-like, liquid-like, film-like, or sheet-like adhesive layer 12*b* (see FIG. 5) laminated (formed) on the entire of the another surface of the heat storage layer 13 by laser, machining, photolithography or the like.

Note that, after the adhesive layer (second adhesive layer) 33 is patterned and laminated on the another surface of the heat storage layer 13, the adhesive layer 33 and the heat storage layer 13 obtained as illustrated in FIG. 13 are overlaid on the adhesive layer 12*a* and the substrate 11 obtained as illustrated in FIG. 7 so that another surface of the adhesive layer 33 (surface opposite to the surface opposed to the heat storage layer 13) contacts with the one surface of the adhesive layer. Then, a predetermined temperature and load are applied uniformly for a certain time period, and hence the substrate 11 and the heat storage layer 13 are bonded (glued) to each other.

According to the thermal head 31 of this embodiment, a part of the another surface of the heat storage layer 13 positioned beneath the region covered with the heat generating portion of each of the plurality of the heating resistors 14 (region opposed to the heat generating portion) is exposed to the cavity portion 34. Therefore, heat dissipation via the adhesive layer 32 can be further suppressed so that the heat generating efficiency can be further improved.

Other actions and effects are the same as those of the embodiment described above, so description thereof is omitted here.

The actions and effects of the thermal printer provided with the thermal head according to this embodiment and the manufacturing method for the thermal head according to this embodiment are the same as those of the embodiment described above, so description thereof is omitted here.

Figure 14:
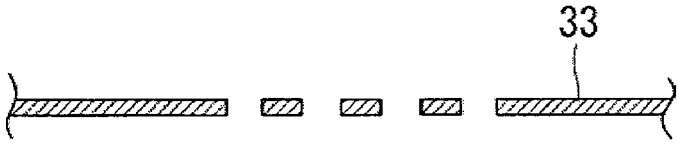
FIG. 14 is a process diagram for illustrating a manufacturing method for a thermal head according to another embodiment of the present invention.

Note that, when the patterned adhesive layer 33 is laminated on the another surface of the heat storage layer 33, the film-like or sheet-like adhesive layer may be patterned in advance as illustrated in FIG. 14 so as to be laminated on the another surface of the heat storage layer 13 having a constant thickness (approximately 2 μm to 100 μm). Alternatively, the paste-like or liquid-like adhesive layer may be printed in a predetermined pattern to be laminated on the another surface of the heat storage layer 13 having a constant thickness (approximately 2 μm to 100 μm) by screen printing, intaglio printing, relief printing, or the like.

Figure 15:
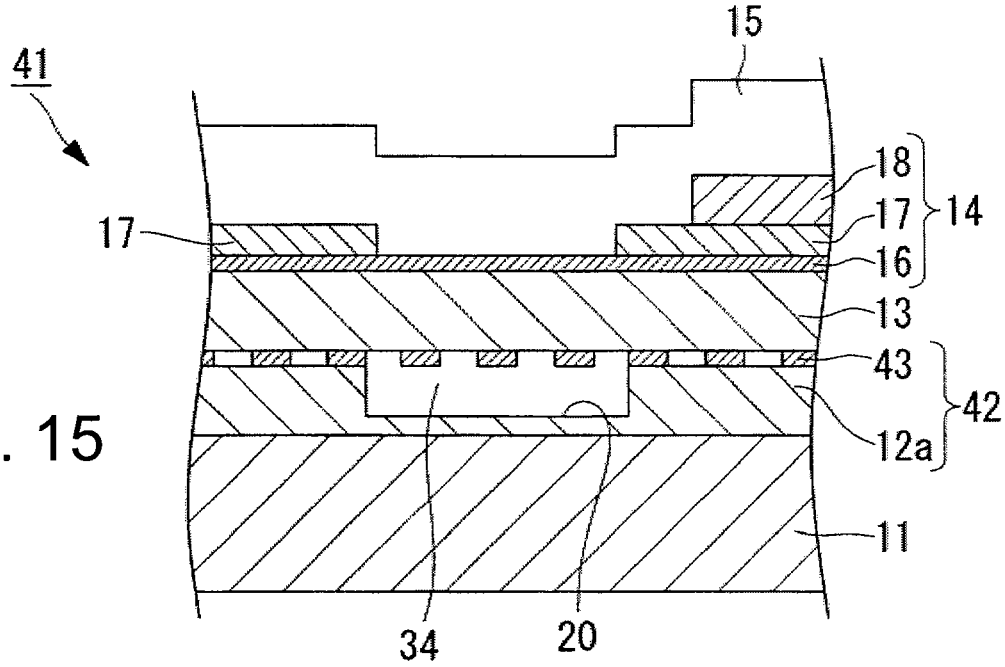
FIG. 15 is a cross sectional view of a thermal head according to a third embodiment of the present invention, which is similar to FIG. 3.

A third embodiment of a thermal head according to the present invention is described with reference to FIG. 15. FIG. 15 is a cross sectional view of the thermal head according to this embodiment, which is similar to FIG. 3.

As illustrated in FIG. 15, the thermal head 41 according to this embodiment is different from those of the embodiments described above in that the former includes an adhesive layer 42 instead of the adhesive layers 12 and 32.

Other components are the same as those of the embodiments described above, so description of the components is omitted here.

The manufacturing steps for the thermal head according to this embodiment include the step of patterning the paste-like, liquid-like, film-like, or sheet-like adhesive layer laminated (formed) on the entire of the another surface of the heat storage layer 13 by laser, machining, photolithography, or the like.

Note that, after the adhesive layer (second adhesive layer) 43 is patterned and laminated on the another surface of the heat storage layer 13, the adhesive layer 43 and the heat storage layer 13 are overlaid on the adhesive layer 12*a* and the substrate 11 obtained as illustrated in FIG. 7 so that another surface of the adhesive layer 43 (surface opposite to the surface opposed to the heat storage layer 13) contacts with the one surface of the adhesive layer 12*a*. Then, a predetermined temperature and load are applied uniformly for a certain time period, and hence the substrate 11 and the heat storage layer 13 are bonded (glued) to each other.

According to the thermal head 41 of this embodiment, a part of the another surface of the heat storage layer 13 is exposed to the cavity portion 34, and a region without the adhesive layer between the another surface of the heat storage layer 13 and the one surface of the substrate 11 (region in which the heat storage layer 13 and the substrate 11 are not bonded to each other via the adhesive layer 42) is formed. Therefore, heat dissipation via the adhesive layer 42 can be suppressed so that the heat generating efficiency can be further improved.

Note that, the coefficient of thermal conductivity of glass is 0.9 W/mK, the coefficient of thermal conductivity of air is 0.02 W/mK, and the coefficient of thermal conductivity of an epoxy resin is 0.21 W/mK.

Other actions and effects are the same as those of the embodiments described above, so description thereof is omitted here.

The actions and effects of the thermal printer provided with the thermal head according to this embodiment and the manufacturing method for the thermal head according to this embodiment are the same as those of the embodiments described above, so description thereof is omitted here.

Note that, when the patterned adhesive layer 43 is laminated on the another surface of the heat storage layer 13, the film-like or sheet-like adhesive layer may be patterned in advance so as to be laminated on the another surface of the heat storage layer 13 having a constant thickness (approximately 2 μm to 100 μm). Alternatively, the paste-like or liquid-like adhesive layer may be printed in a predetermined pattern to be laminated on the another surface of the heat storage layer 13 having a constant thickness (approximately 2 μm to 100 μm) by screen printing, intaglio printing, relief printing or the like.

Figure 16:
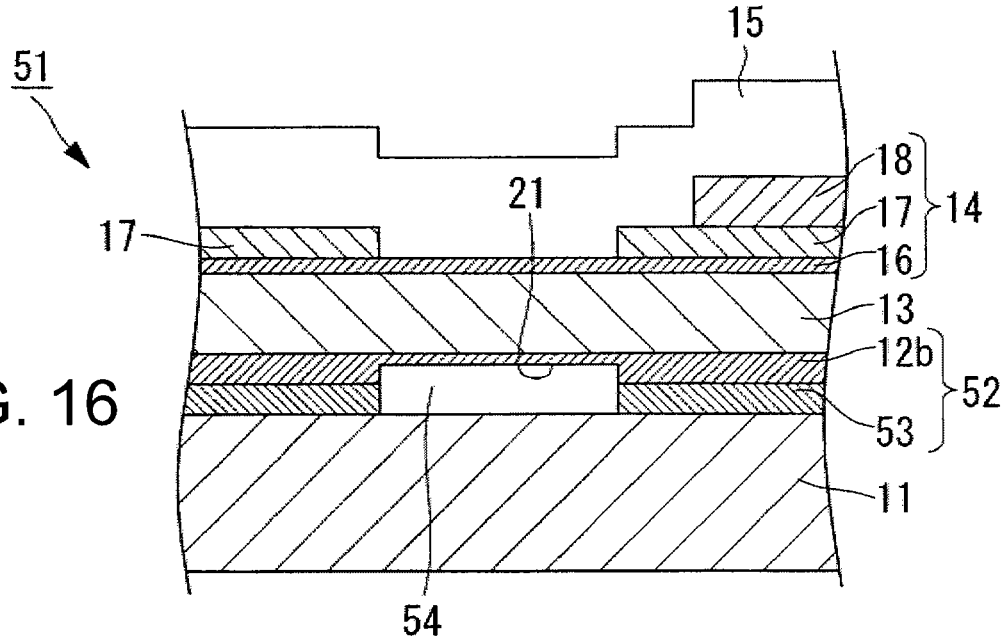
FIG. 16 is a cross sectional view of a thermal head according to a fourth embodiment of the present invention, which is similar to FIG. 3.

A fourth embodiment of a thermal head according to the present invention is described with reference to FIG. 16. FIG. 16 is a cross sectional view of the thermal head according to this embodiment, which is similar to FIG. 3.

As illustrated in FIG. 16, the thermal head 51 according to this embodiment is different from that of the embodiments described above in that the former includes an adhesive layer 52 instead of the adhesive layers 12, 32, and 42.

Other components are the same as those of the embodiments described above, so description of the components is omitted here.

Figure 17:
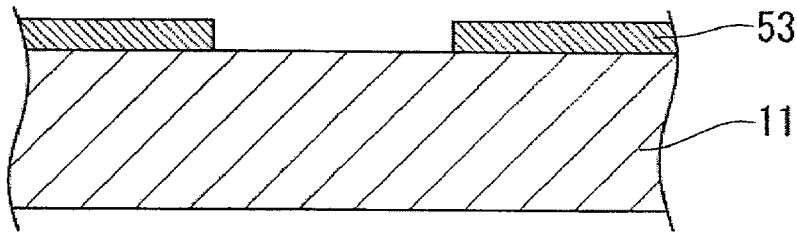
FIG. 17 is a process diagram for illustrating a manufacturing method for a thermal head according to another embodiment of the present invention.

The manufacturing steps for the thermal head 51 according to this embodiment include the step illustrated in FIG. 17, i.e., the step of patterning the paste-like, liquid-like, film-like, or sheet-like adhesive layer 12*a* (see FIG. 6) laminated (formed) on the entire of the one surface of the substrate 11 by laser, machining, photolithography, or the like.

Note that, after the patterned adhesive layer (first adhesive layer) 53 is laminated on the one surface of the substrate 11, the adhesive layer 12*b* and the heat storage layer 13 obtained as illustrated in FIG. 5 are overlaid on the adhesive layer 53 and the substrate 11 obtained as illustrated in FIG. 17 so that the another surface of the adhesive layer 12*b* (surface opposite to the surface opposed to the heat storage layer 13) contacts with one surface of the adhesive layer 53. Then, a predetermined temperature and load are applied uniformly for a certain time period, and hence the substrate 11 and the heat storage layer 13 are bonded (glued) to each other.

According to the thermal head 51 of this embodiment, a part of the one surface of the substrate 11 positioned beneath the region covered with the heat generating portion of each of the plurality of the heating resistors 14 (region opposed to the heat generating portion) is exposed to the cavity portion 54. Therefore, heat dissipation via the adhesive layer 52 can be further suppressed so that the heat generating efficiency can be further improved.

Other actions and effects are the same as those of the embodiments described above, so description thereof is omitted here.

The actions and effects of the thermal printer provided with the thermal head according to this embodiment and the manufacturing method for the thermal head according to this embodiment are the same as those of the embodiments described above, so description thereof is omitted here.

Figure 18:
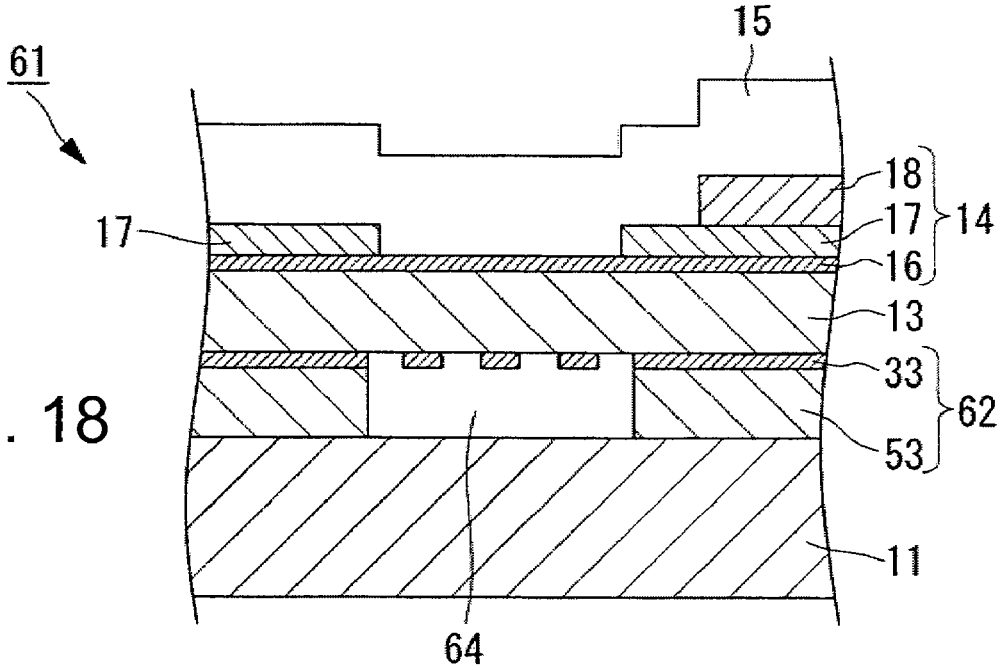
FIG. 18 is a cross sectional view of a thermal head according to a fifth embodiment of the present invention, which is similar to FIG. 3.

A fifth embodiment of a thermal head according to the present invention is described with reference to FIG. 18. FIG. 18 is a cross sectional view of the thermal head according to this embodiment, which is similar to FIG. 3.

As illustrated in FIG. 18, the thermal head 61 according to this embodiment is different from those of the embodiments described above in that the former includes an adhesive layer 62 instead of the adhesive layers 12, 32, 42, and 52.

Other components are the same as those of the embodiments described above, so description of the components is omitted here.

The manufacturing steps for the thermal head 61 according to this embodiment include the step illustrated in FIG. 13, i.e., the step of patterning the paste-like, liquid-like, film-like, or sheet-like adhesive layer 12*b* (see FIG. 5) laminated (formed)

on the entire of the another surface of the heat storage layer 13 by laser, machining, photolithography or the like.

Note that, after the patterned adhesive layer 33 is laminated on the another surface of the heat storage layer 13, the adhesive layer 33 and the heat storage layer 13 obtained as illustrated in FIG. 13 are overlaid on the adhesive layer 53 and the substrate 11 obtained as illustrated in FIG. 17 so that the another surface of the adhesive layer 33 (surface opposite to the surface opposed to the heat storage layer 13) contacts with the one surface of the adhesive layer 12. Then, a predetermined temperature and load are applied uniformly for a certain time period, and hence the substrate 11 and the heat storage layer 13 are bonded (glued) to each other.

According to the thermal head 61 of this embodiment, a part of the another surface of the heat storage layer 13 positioned beneath the region covered with the heat generating portion of each of the plurality of the heating resistors 14 (region opposed to the heat generating portion) is exposed to the cavity portion 64. Therefore, heat dissipation via the adhesive layer 62 can be further suppressed so that the heat generating efficiency can be further improved.

Other actions and effects are the same as those of the embodiments described above, so description thereof is omitted here.

The actions and effects of the thermal printer provided with the thermal head according to this embodiment and the manufacturing method for the thermal head according to this embodiment are the same as those of the embodiments described above, so description thereof is omitted here.

Note that, when the patterned adhesive layer 33 is laminated on the another surface of the heat storage layer 13, the film-like or sheet-like adhesive layer may be patterned in advance as illustrated in FIG. 14 so as to be laminated on the another surface of the heat storage layer 13 having a constant thickness (approximately 2 μm to 100 μm). Alternatively, the paste-like or liquid-like adhesive layer may be printed in a predetermined pattern to be laminated on the another surface of the heat storage layer 13 having a constant thickness (approximately 2 μm to 100 μm) by screen printing, intaglio printing, relief printing, or the like.

Figure 19:
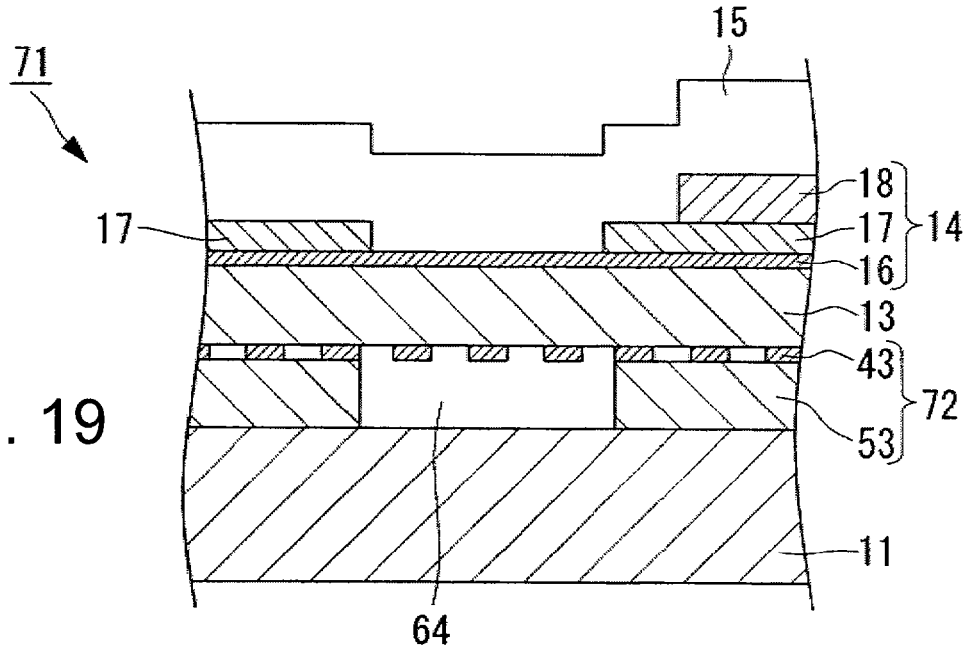
FIG. 19 is a process diagram for illustrating a manufacturing method for a thermal head according to a sixth embodiment of the present invention.
Figure 20:
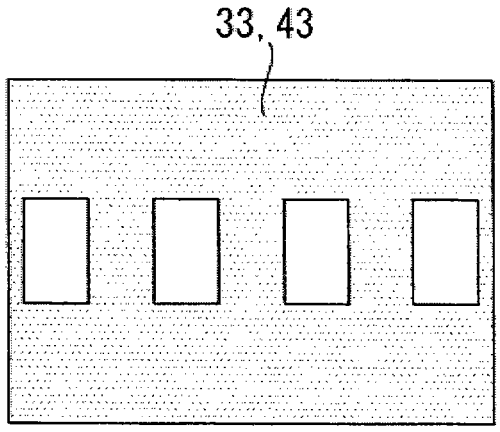
FIG. 20 is a diagram illustrating a concrete example of patterning an adhesive layer, which is a plan view of the adhesive layer viewed from a heat storage layer side or a substrate side.
Figure 21:
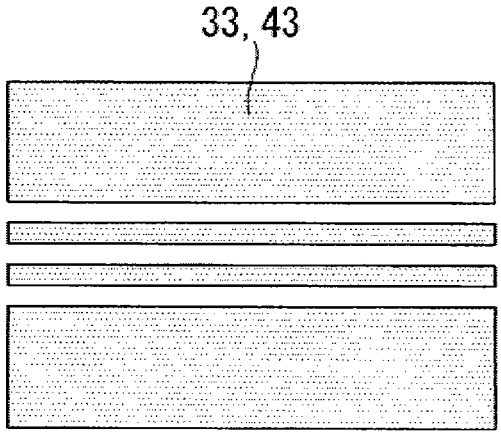
FIG. 21 is a diagram illustrating a concrete example of patterning the adhesive layer, which is a plan view of the adhesive layer viewed from the heat storage layer side or the substrate side.
Figure 22:
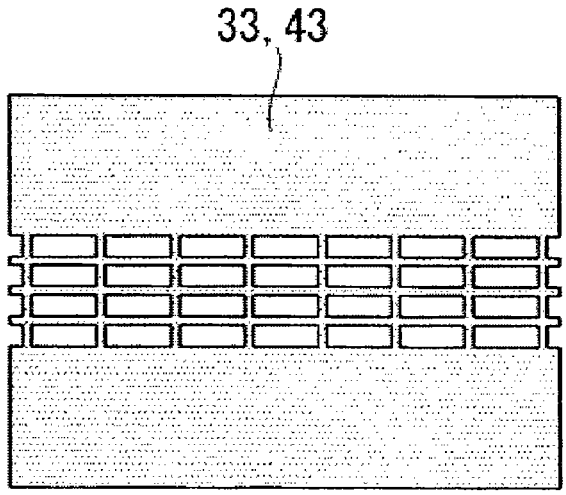
FIG. 22 is a diagram illustrating a concrete example of patterning the adhesive layer, which is a plan view of the adhesive layer viewed from the heat storage layer side or the substrate side.
Figure 23:
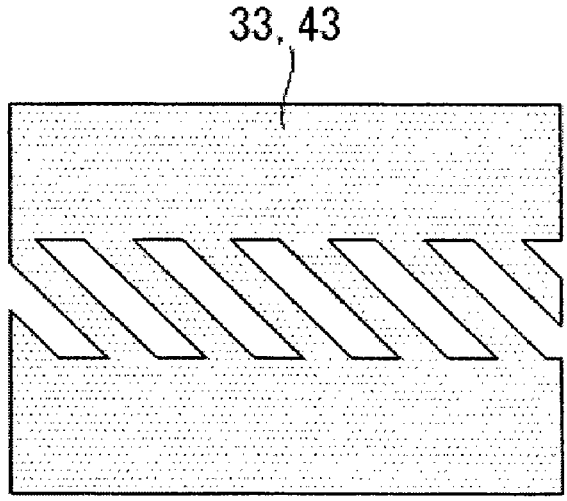
FIG. 23 is a diagram illustrating a concrete example of patterning the adhesive layer, which is a plan view of the adhesive layer viewed from the heat storage layer side or the substrate side.
Figure 24:
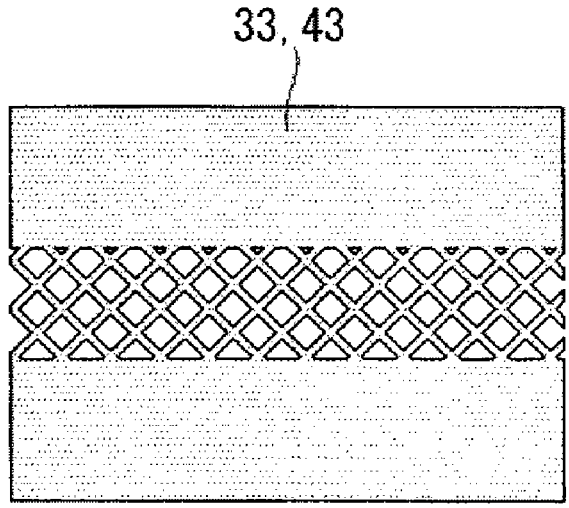
FIG. 24 is a diagram illustrating a concrete example of patterning the adhesive layer, which is a plan view of the adhesive layer viewed from the heat storage layer side or the substrate side.
Figure 25:
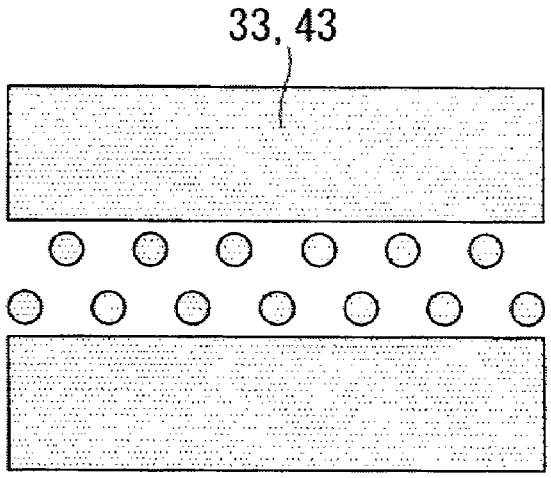
FIG. 25 is a diagram illustrating a concrete example of patterning the adhesive layer, which is a plan view of the adhesive layer viewed from the heat storage layer side or the substrate side.
Figure 26:
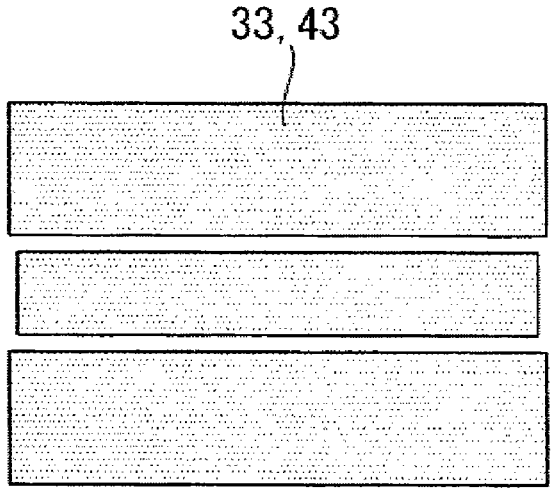
FIG. 26 is a diagram illustrating a concrete example of patterning the adhesive layer, which is a plan view of the adhesive layer viewed from the heat storage layer side or the substrate side.
Figure 27:
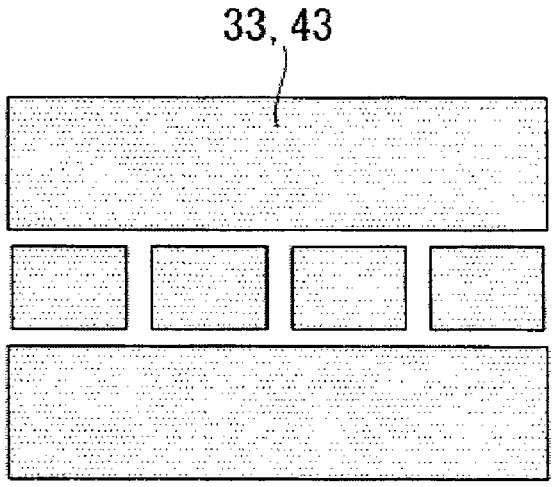
FIG. 27 is a diagram illustrating a concrete example of patterning the adhesive layer, which is a plan view of the adhesive layer viewed from the heat storage layer side or the substrate side.

A sixth embodiment of a thermal head according to the present invention is described with reference to FIG. 19. FIG. 19 is a cross sectional view of the thermal head according to this embodiment, which is similar to FIG. 3.

As illustrated in FIG. 19, the thermal head 71 according to this embodiment is different from those of the embodiments described above in that the former includes an adhesive layer 72 instead of the adhesive layers 12, 32, 42, 52, and 62.

Other components are the same as those of the embodiments described above, so description of the components is omitted here.

The manufacturing steps for the thermal head according to this embodiment include the step of patterning the paste-like, liquid-like, film-like, or sheet-like adhesive layer laminated (formed) on the entire of the another surface of the heat storage layer 13 by laser, machining, photolithography, or the like.

Note that, after the patterned adhesive layer 43 is laminated on the another surface of the substrate 11, the adhesive layer 43 and the heat storage layer 13 are overlaid on the adhesive layer 53 and the substrate 11 obtained as illustrated in FIG. 17 so that the another surface of the adhesive layer 43 (surface opposite to the surface opposed to the heat storage layer 13) contacts with the one surface of the adhesive layer 53. Then, a predetermined temperature and load are applied uniformly for a certain time period, and hence the substrate 11 and the heat storage layer 13 are bonded (glued) to each other.

According to the thermal head 71 of this embodiment, a part of the another surface of the heat storage layer 13 is exposed to the cavity portion 64, and a region without the adhesive layer between the another surface of the heat storage layer 13 and the one surface of the substrate 11 (region in which the heat storage layer 13 and the substrate 11 are not bonded to each other via the adhesive layer 52) is formed. Therefore, heat dissipation via the adhesive layer 52 can be suppressed so that the heat generating efficiency can be further improved.

Note that, the coefficient of thermal conductivity of glass is 0.9 W/mK, the coefficient of thermal conductivity of air is 0.02 W/mK, and the coefficient of thermal conductivity of an epoxy resin is 0.21 W/mK.

Other actions and effects are the same as those of the embodiments described above, so description thereof is omitted here.

The actions and effects of the thermal printer provided with the thermal head according to this embodiment and the manufacturing method for the thermal head according to this embodiment are the same as those of the embodiments described above, so description thereof is omitted here.

Note that, when the patterned adhesive layer 43 is laminated on the another surface of the heat storage layer 13, the film-like or sheet-like adhesive layer may be patterned in advance so as to be laminated on the another surface of the heat storage layer 13 having a constant thickness (approximately 2 μm to 100 μm). Alternatively, the paste-like or liquid-like adhesive layer may be printed in a predetermined pattern to be laminated on the another surface of the heat storage layer 13 having a constant thickness (approximately 2 μm to 100 μm) by screen printing, intaglio printing, relief printing or the like.

FIGS. 20 to 27 illustrate concrete examples of patterning the adhesive layers 33 and 43, which are plan views of the adhesive layers 33 and 43 viewed from the side of the heat storage layer 13 or the side of the substrate 11.

Note that, the thermal head of the present invention is not limited to the embodiments described above, which can be appropriately modified, changed and combined depending on necessities.

For instance, the same numbers of the cavity portions 19, 34, 54, and 64 are formed as the heating resistors 14 in the embodiments described above, but the present invention is not limited to this structure. The cavity portions 19, 34, 54, and 64 may be formed to be connected over the heating resistors 14 along the arrangement direction of the heating resistors 14, so as to constitute one cavity portion.

According to the thermal head having the cavity portions described above, neighboring cavity portions are communicated to each other, and a part of an outflow path for heat (heat quantity) generated in the heating resistor 14 to the inside of the substrate 11 is blocked. Therefore, flowing out of the heat (heat quantity) generated in the heating resistor 14 to the inside of the substrate 11 can be further suppressed, heat generating efficiency of the heating resistor 14 can be further improved, and electric power consumption can be further reduced.

In addition, the above embodiments describe the thermal head and the thermal printer 1 that directly develops color by heat, but the present invention is not limited to this structure. The present invention can also be applied to a heating resistance element other than the thermal head or to a printer device other than the thermal printer 1.

For instance, the present invention can be applied to a heating resistance element component such as a thermal type inkjet head for jetting ink by heat or a valve type inkjet head.

In addition, the present invention can also be applied to other film-like electronic components having a film heating resistance element component such as a thermal erase head having a substantially similar structure to that of the thermal head, a fixing heater for a printer, or the like that needs thermal fixing, or a thin film heating resistance element of a light guide type optical component, and hence similar effects can be obtained.

Further, the present invention can be applied to a printer such as a thermal transfer printer using a sublimation type or a melting type transfer ribbon, a rewritable thermal printer capable of developing color and discharging of a print medium, or a heat-sensitive adhesive activating label printer, the adhesive exhibiting thermal adhesiveness.

What is claimed is:

1. A thermal head comprising:

a supporting substrate;

a heat storage layer laminated on a surface of the supporting substrate via an adhesive layer made of an elastic material; and a plurality of heating resistors arranged with spaces therebetween on the heat storage layer, wherein:

a cavity portion is formed at a region between the supporting substrate and the heat storage layer, the region being opposed to each of heat generating portions of the heating resistors;

the adhesive layer comprises a first adhesive layer laminated on the surface of the supporting substrate and a second adhesive layer laminated on the surface of a heat storage layer such that the entire surface of the heat storage layer is covered with the second adhesive layer; and the elastic material constituting the second adhesive layer is arranged so that the elastic material is in a bonded state with respect to at least a part of the surface of the heat storage layer opposed to the cavity portion, wherein a part of the surface of the heat storage layer opposed to the surface of the supporting substrate exposed to the cavity portion is exposed to the cavity portion.

2. A thermal printer provided with the thermal head according to claim 1.

3. A manufacturing method for a thermal head, comprising:

laminating a first adhesive layer made of an elastic material on an entire surface of a supporting substrate;

forming a first concave portion in a surface of the first adhesive layer;

laminating a second adhesive layer made of an elastic material on an entire surface of a heat storage layer;

forming a second concave portion in a surface of the second adhesive layer; and bonding the first adhesive layer and the second adhesive layer to each other so that the first concave portion and the second concave portion formed respectively in the first adhesive layer and the second adhesive layer are combined.

4. A manufacturing method for a thermal head according to claim 3, further comprising exposing a part of the supporting substrate to an inside of the first concave portion.

5. A manufacturing method for a thermal head according to claim 3, further comprising exposing a part of the heat storage layer to an inside of the second concave portion.

6. A thermal head comprising:

a supporting substrate;

a heat storage layer laminated on a surface of the supporting substrate via an adhesive layer made of an elastic material; and a plurality of heating resistors arranged with spaces therebetween on the heat storage layer, wherein:

a cavity portion is formed at a region between the supporting substrate and the heat storage layer, the region being opposed to each of heat generating portions of the heating resistors;

the adhesive layer comprises a first adhesive layer laminated on the surface of the supporting substrate and a second adhesive layer laminated on the surface of a heat storage layer; and the elastic material constituting the second adhesive layer is arranged so that the elastic material is in a bonded state with respect to at least a part of the surface of the heat storage layer opposed to the cavity portion, wherein a part of the surface of the heat storage layer opposed to the surface of the supporting substrate exposed to the cavity portion is exposed to the cavity portion.

* * * * *